US005146908A

United States Patent [19]

Larson

[11] Patent Number: 5,146,908

[45] Date of Patent: Sep. 15, 1992

[54] HOLD-BACK SYSTEM FOR BOWSTRING

[75] Inventor: Marlow W. Larson, Ogden, Utah

[73] Assignee: Browning, Morgan, Utah

[21] Appl. No.: 496,858

[22] Filed: Mar. 21, 1990

[51] Int. Cl.[5] ..... F41B 5/00

[52] U.S. Cl. ..... 124/88; 124/25.6

[58] Field of Search ..... 124/88, 89, 90, 25.6, 124/23.1, 24.1, 86

[56] References Cited

U.S. PATENT DOCUMENTS

| | | | |
|---|---|---|---|
| 2,664,078 | 12/1953 | Irwin | 124/24.1 |
| 2,926,650 | 3/1960 | Irwin | 124/24.1 |
| 3,446,200 | 5/1969 | Gross | 124/24.1 |
| 3,512,512 | 5/1970 | Wentz | 124/24.1 |
| 3,794,012 | 2/1974 | Ramsey | 124/24.1 |
| 4,615,326 | 10/1986 | Rathbun | 124/88 |
| 4,732,133 | 3/1988 | Chattin | 124/24.1 |
| 4,919,107 | 4/1990 | Bunts | 124/24.1 |
| 5,000,154 | 3/1991 | Slayton | 124/23.1 |
| 5,002,035 | 3/1991 | Brooks | 124/23.1 |

*Primary Examiner*—Randolph A. Reese
*Assistant Examiner*—John Ricci
*Attorney, Agent, or Firm*—Trask, Britt & Rossa

[57] ABSTRACT

A hold-back system for an archery bow having an overdraw structure includes a device with a spring-biased arm. The arm may be positioned to intercept the bowstring when partially drawn and hold it in that position. When the bowstring is further drawn to fire the arrow, the arm automatically retracts away from the bowstring. The hold-back device is adjustably attachable to an existing cable guard or to a separate mounting rod.

24 Claims, 4 Drawing Sheets

HOLD-BACK SYSTEM FOR BOWSTRING

BACKGROUND

1. Field

This invention relates to archery bows and more particularly relates to archery bows having an overdraw apparatus. The invention is specifically directed to an improvement for controlling the resting position for nocked arrows in overdraw systems.

2. State of the Art

As typically configured, compound archery bows include a handle, a pair of limbs extending from opposite ends of the handle to present spaced opposed limb tips, and a pair of eccentric elements rotatably mounted on eccentric axes associated with the respective limb tips. The eccentric elements and limb tips are interconnected by a rigging system which includes the eccentric elements and stretches of cabling or similar tension runs constructed of aircraft cable or bowstring materials. The cabling includes a central stretch, generally including the bowstring, and a pair of end stretches, each extending from an eccentric element to the opposite limb tip.

Archery bows are designed to convert energy stored in the limbs into high acceleration of the arrow. Shorter, stiffer arrows may be driven at higher velocities and with flatter trajectories and greater range than the more conventional longer arrows. Bows are adapted to shoot shorter arrows with a full draw by shortening the distance from the arrow rest to the bowstring. Such bows, whether of simple recurve design or compound type, are herein designated as "overdraw archery bows." A rearward extending "overdraw" apparatus having an arrow rest is attached to the bow handle. The arrow rest is thus moved to a position on the overdraw behind the bow handle, enabling the use of short arrows.

However, an overdraw system may shorten the arrow rest-to-bowstring distance to the extent that the fletching of an arrow in an at-rest position extends into the arrow rest portion of the overdraw. The arrow will be hindered from seating on the arrow rest, requiring the bowstring to be partially drawn before the arrow can be properly seated. Continuously holding the bowstring in a partially drawn position prior to fully drawing and releasing is inconvenient, requires additional energy, and interferes with repeatable, accurate use of the bow.

In addition, feather fletching may catch on the arrow rest and be damaged when the arrow is drawn.

The need exists for a means to increase the arrow rest-to-bowstring distance in bows with overdraw structures.

SUMMARY OF THE INVENTION

The invention is a means for holding back the drawstring of an archery bow in a partially drawn position. The hold-back means, hereinafter called a hold-back, is useful for a bow having an overdraw apparatus.

The hold-back is mounted on a cable guard rod such as used with compound bows, or on a separate support rod attached to the bow handle. The hold-back includes a movable spring-biased arm, biasing means such as a weight or spring, for moving the arm, and attachment means for adjustably mounting the hold-back apparatus on the cable guard rod or support rod.

In use, the archer partially draws the bowstring and places it on the hold-back arm. The latter is held, against the biasing force, in a position where it intersects the drawn bowstring path. The bowstring is then held in the partially drawn position where the arrow will be properly seated on the arrow rest, without interference of the fletching.

When the archer further draws the bowstring for firing the arrow, the bowstring pressure on the hold-back arm is withdrawn, and the biasing means motivates the arm to a retracted position where it will not interfere with the released bowstring or arrow.

Thus, the hold-back provides a secondary, adjustable "at rest" arrow position for use with bows having overdraw structures. The hold-back is compact, lightweight and readily adaptable to the wide variety of existing bow sizes and styles and to different existing cable guards.

DESCRIPTION OF THE DRAWINGS

In the drawings, which illustrate what is currently regarded as the best mode for carrying out the invention.

DESCRIPTION OF THE PREFERRED EMBODIMENT

Figure 1:
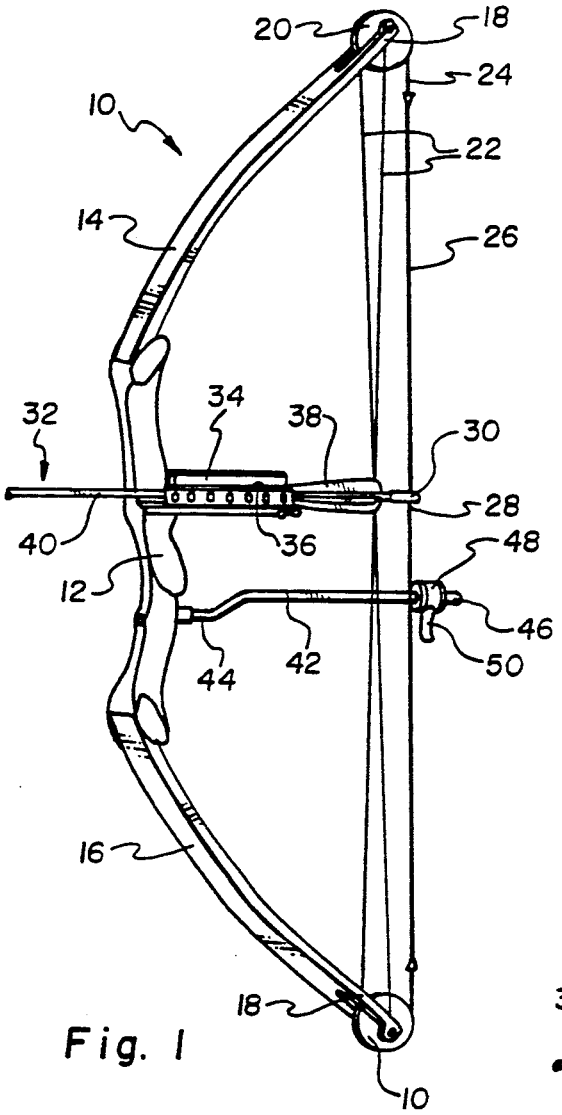
FIG. 1 is a schematic drawing of a typical compound archery bow including the invention prior to use.

The compound bow 10 illustrated by FIG. 1 includes a handle or handle riser 12, a pair of limbs 14, 16 extending from opposite ends of the handle 12. On each limb tip 18 is rotatably mounted an eccentric element 20, and the limb tips 18 and opposite eccentric elements 20 are strung with end stretches 22 and central stretch 24. The latter includes drawstring or bowstring 26, shown, with nocking point 28 inserted into the nock 30 of arrow 32.

Figure 3:
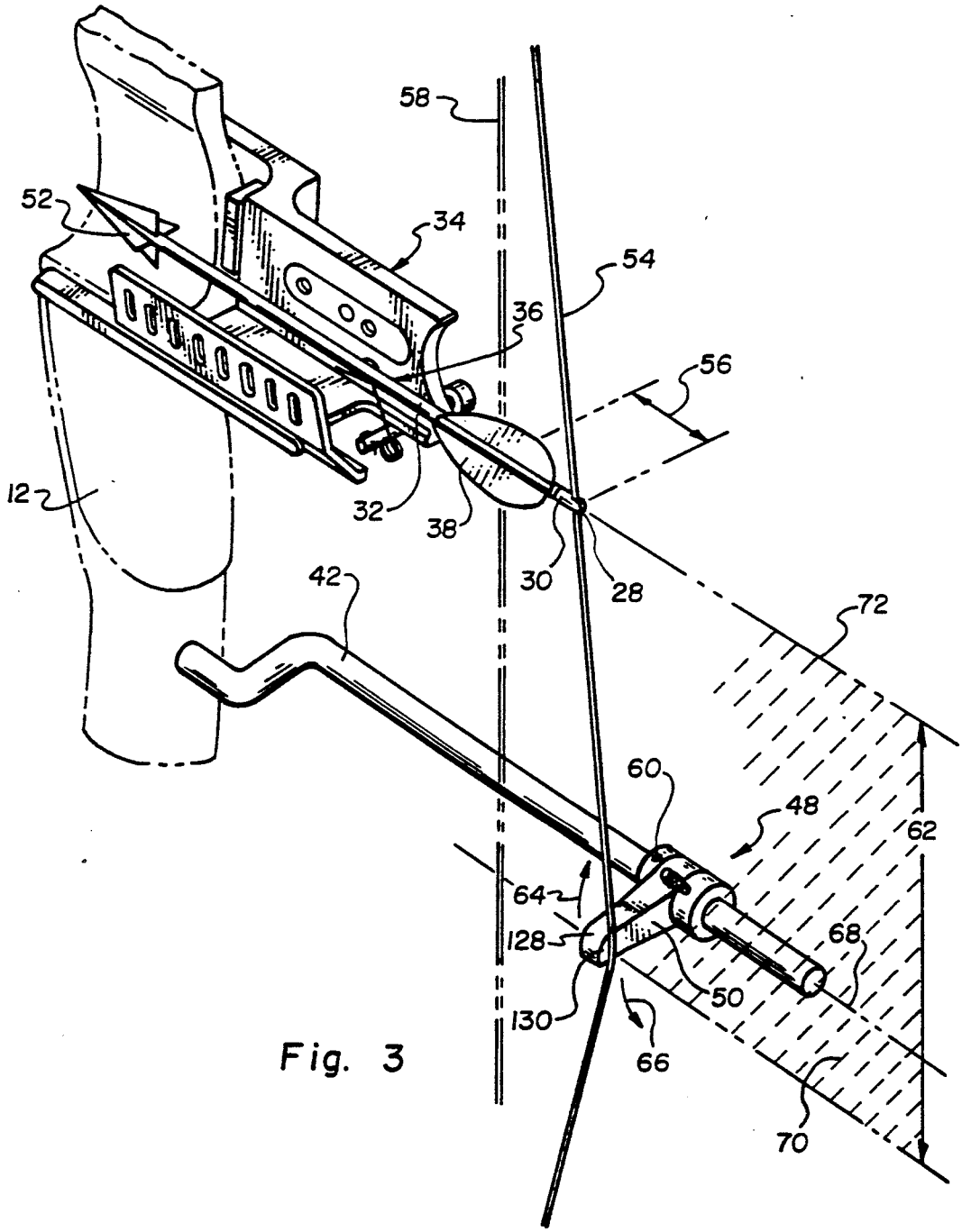
FIG. 3 is a perspective partial view of a bow illustrating the use of the invention.

Bow 10 is shown with an attached overdraw structure 34 which contains an arrow rest 36 (FIG. 3). Such overdraw apparatuses and arrow rests are well known in the field of archery. The overdraw 34 extends backwardly toward the bowstring 26 and supports the arrow rest 36 in a position behind the bow handle 12. As shown in FIG. 1, fletching 38 is mounted on shaft 40 of arrow 32, and in the at-rest position shown, the fletching 38 may detrimentally extend into the overdraw structure 34 to interfere with the arrow's placement and retention on the arrow rest 36. In practice, arrow rest 36 may be placed at any distance from the handle 12 along the length of the overdraw structure 34, or it may be restricted to limited adjustment by the particular construction. If the distance from the arrow rest 36 to bowstring 26 is much reduced, there will be insufficient clearance therebetween for the fletching 38 and nock 30.

Bow 10 is shown with support shaft 42 which may comprise a cable guard rod to keep end stretch cables 22 out of the path of the arrow 32. The forward end 44 of the support shaft 42 is attached to the bow handle 12, and the rear end 46 extends backward past bowstring 26. Hold-back 48 having a retracted string holding arm 50 is mounted on support shaft 42 behind the normal at-rest position of bowstring 26 (FIG. 1).

Figure 2:
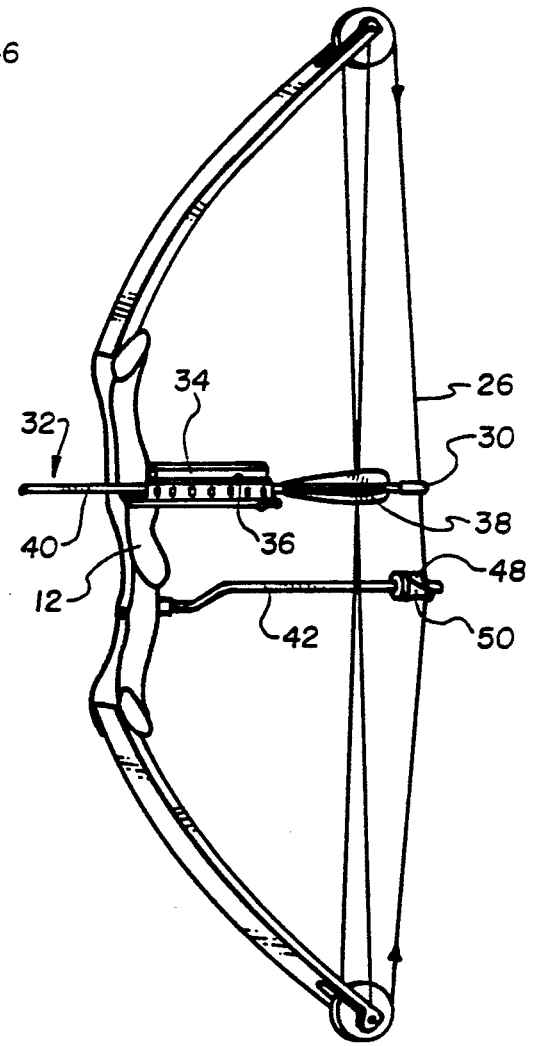
FIG. 2 is a schematic drawing of the bow of FIG. 1, illustrating use of the invention.

FIG. 2 illustrates the bow 10 with string holding arm 50 of hold-back 48 pivoted to intersect the draw path of bowstring 26. The bowstring is partially drawn and placed on arm 50 where it is retained at its partially drawn, secondary "at rest" position The rest position of nocked arrow 32 on arrow rest 36 is thus moved backward to eliminate interference between the arrow fletching 38 and arrow rest 36 or overdraw 34.

Support shaft 42 may serve as a cable guard as well as a support for the hold-back. The hold-back is generally designed to fit on existing cable guard rods.

FIG. 3 is an enlarged perspective view of the bow of FIG. 2, illustrating in more detail the use of the invention. Bow handle 10 is shown with attached overdraw 34. An arrow rest 36 is mounted on overdraw 34. Hold-back 48 is slidingly mounted on support shaft 42 which in turn is fixedly mounted on bow handle 12. Arrow 32 with fletching 38, arrowhead 52 and nock 30 is shown in a partially drawn, hold-back position on held-back bowstring 54. The nocking point 28 of the bowstring 54 is thus held a distance 56 rearward of the normal "at-rest" bowstring position 58.

The hold-back 48 is movably adjustable on shaft 42 to achieve the desired hold-back distance 56. In this embodiment of the invention, set screw 60 is loosened to permit hold-back 48 to slide on support shaft 42 to a desired position, where the set screw 60 is tightened.

Preferably, the distance 62 between hold-back 48 and arrow nock 30 is as short as possible, particularly when the hold-back distance 56 is more than several inches. However, distance 56 must be sufficient to prevent interference of hold-back 48 and support shaft 42 with the arrow drawing and arrow release operations. Commercial compound bows typically have a cable guard mounted in a position which is ideal, or nearly so, for the hold-back.

Hold-back 48 includes arm 50 which rotates in direction 64 or 66 around axis 68 between the string holding position shown and a retracted position (FIG. 1) parallel to the bowstring, where it will not interfere with full drawing and firing of an arrow. In other words, arm 50 is retracted to a position where it does not intersect the bowstring's plane of movement 70, in which lie bowstring 54 and arrow axis 72.

Figure 4:
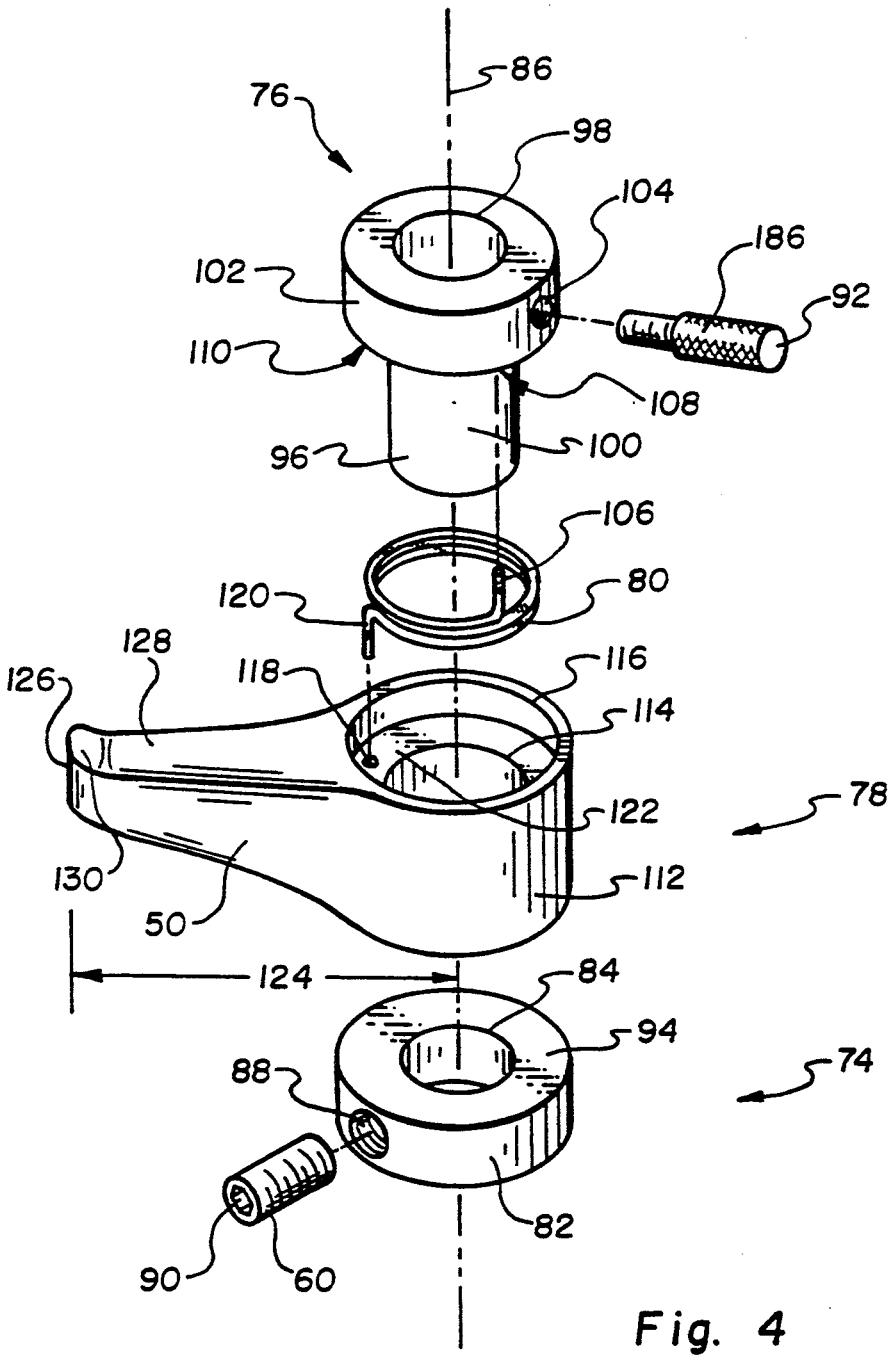
FIG. 4 is an exploded pictorial representation of one embodiment of the hold-back of the invention.

The components of the embodiment of FIG. 3 of the invention are shown in detail in FIG. 4. The four major parts are retaining ring means 74, pivot collar means 76, pivot arm means 78 and biasing means 80, which may be a spring or weight.

Retaining ring means 74 includes ring 82 with passageway 84. Ring 82 slides onto a support shaft, (not shown), which is oriented along axis 86, and is locked at a desired location thereon by tightening of setscrew 60 in screw hole 88 against the support shaft. Setscrew 60 may have a fitting 90 for rotation by an Allen wrench or other wrench style or may have an exposed head 92 for adjustment without need of tools. Ring 82 has a bearing surface 94 for retaining the other elements of the hold-back.

Pivot collar means 76 comprises a tubular element 96 which has a passageway 98 therethrough for mounting on the support shaft. The exterior rounded surface 100 is a bearing or guide surface for rotation of the pivot arm means 78. One end of element 96 has an enlarged annular collar 102 with a radially directed setscrew 92 in screw hole 104 for locking pivot collar means 76 to the support shaft. One end 106 of spring 80 is attachable to element 96 by attachment means 108, which is preferably a hole into which the end 106 fits. The latter is preferably mounted on collar side surface 110. Alternatively, the end 106 may be attached to a screw or other attachment means.

Pivot arm means 78 includes string retaining arm 50 extending from a hub 112. Hub 112 has a passageway 114 therethrough for mounting on tubular element 96 and an enlarged circular recessed portion 116. An attachment means 118 may be a hole in the recessed portion 116 into which spring end 120 is fitted. Alternatively, a screw or other means may be used to attach the spring.

When assembled on the support shaft at a location rearward of the normal "at-rest" position of the bowstring, spring 80 lies in recessed portion 116 between opposing surfaces 110 and 122, and motivates pivot arm 50 about axis 86, i.e., about the support shaft.

FIG. 4 shows spring 80 as a tightly wound coil spring held by its ends 106 and 120. However, other types of springs and attachment means may alternatively be used. In addition, biasing means 80 may be a counterweight which retracts arm 50.

The length 124 of arm 50 from its axis 86 to its distal end 126 depends on the proximity of the support shaft to the bowstring path. The arm length 124 will preferably be 1½ to 2½ inches, although arms of lesser or greater lengths may be used.

Arm 50 has a smooth string retaining surface 128, and preferably has an enlarged or raised end 130 for preventing the bowstring from slipping therefrom.

With the coil spring shown in FIG. 4, complete compression to its normal relaxed position acts as a "stopping" action to prevent further retraction of the arm. The length of spring 80, and locations of attachment means 108 and 118 are controlled to provide a "stopped" retraction position of the arm which will not interfere with the discharged bowstring and arrow.

The forward force of the partially drawn bowstring will maintain arm 50 in a string retaining position, and the arm 50 will automatically retract upon further drawing of the bowstring.

Figure 5:
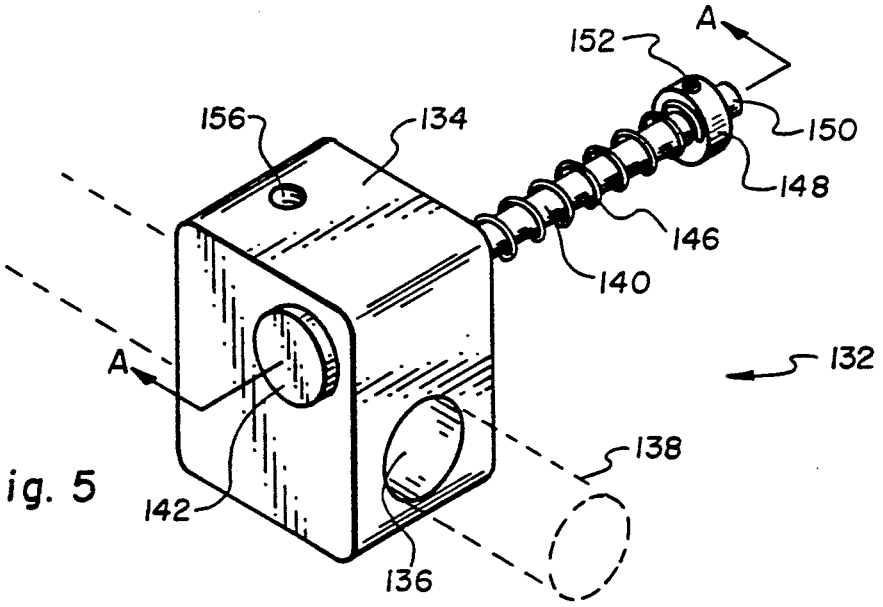
FIG. 5 is a perspective view of another embodiment of the invention.
Figure 6:
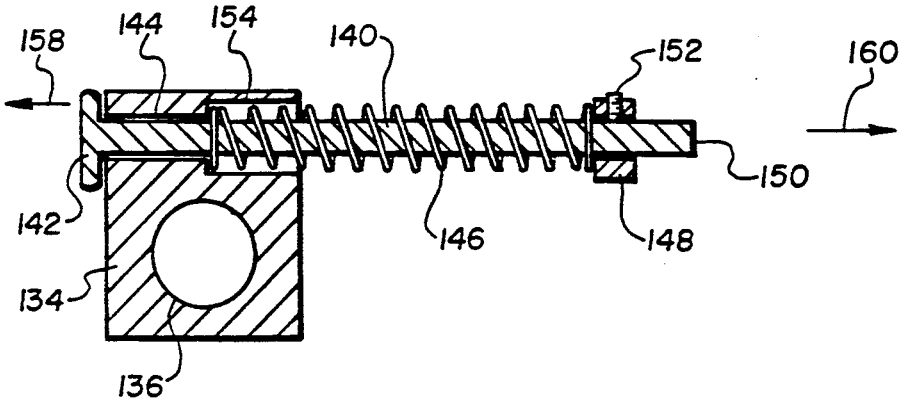
FIG. 6 is a sectional end view along lines A—A of the hold-back of FIG. 5.

FIGS. 5 and 6 depict another embodiment of this invention. Hold-back means 132 is shown as including a body 134 having a passageway 136 therethrough for mounting on support rod 138. Bowstring retaining arm 140 with enlarged head 142 is mounted in passageway 144 through body 134. Spring 146 is mounted on arm 140 and held thereon in compression by spring retainer means 148. The latter is held on the tail end 150 of arm 140 by set screw 152 or other means. The body 134 may be recessed as shown at 154 for retaining the opposite end of spring 146. The body 134 is locked to support rod 138 by set screw 156 or other means. Its working position is rearward of the normal at-rest position of the bowstring.

This embodiment is used by pushing arm 140 in direction 158 and placing the partially drawn bowstring on it. Further drawing releases the arm and it immediately returns, by spring action, in direction 160 to the retracted position shown in FIGS. 5 and 6.

Figure 7:
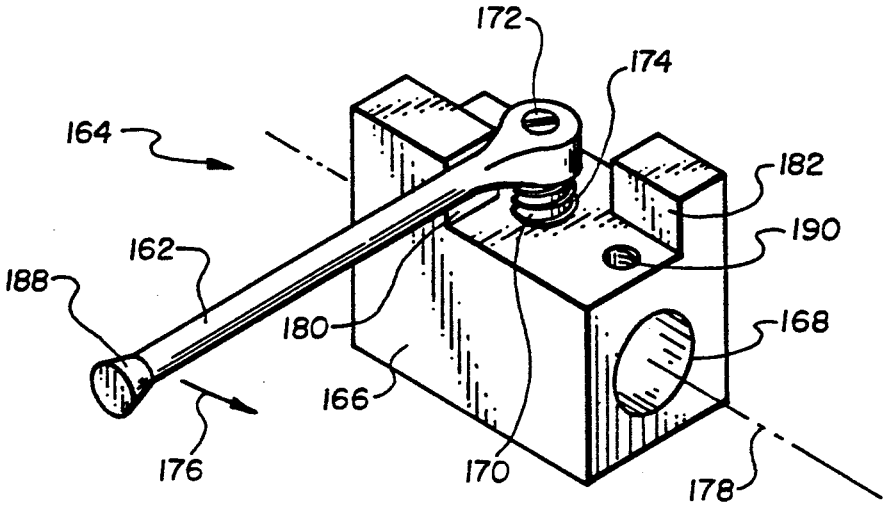
FIG. 7 is a perspective view of a further embodiment of the invention.

FIG. 7 shows a further embodiment in which the bowstring retaining arm 162 rotates or pivots in a plane generally perpendicular to the bowstring.

Hold-back means 164 includes a body 166 having passageway 168 therethrough for mounting on a support rod, not shown.

Arm 162 is mounted on shaft or post 170 by attachment means 172 to pivot relative to the body. Spring 174 has opposite ends, not shown, attached to the arm 162 and body 166 to motivate arm 162 in direction 176 to a retracted position parallel with the support rod along axis 178. The spring length and attachment locations may be varied to control the force exerted by the spring 174.

Preferably, body 166 includes stop surface 180 for preventing forward movement of arm 162 from its string retaining position, and stop surface 182 for retaining the arm in a retracted position.

The particular embodiments illustrated and described herein each provides a hold-back function in which the hold-back arm is self-retractable. The retraction force may be varied, and the hold-back distance is also controllably variable. The apparatus permits bows to be substantially overdrawn without interference of arrow fletching, etc., with the overdraw arrow rest. The hold-back function and cable guard function may be combined in a single unit.

Reference herein to details of the illustrated embodiments is not intended to restrict the scope of the appended claims which themselves recite those features regarded as important to the invention.

What is claimed:

1. A bowstring hold-back apparatus for an archery bow with an overdraw structure and a bowstring having an at-rest position, comprising:

a support shaft mounted on said bow and extending rearward past said at-rest position of said bowstring;

arm means mounted on said support shaft rearward of the at-rest position of said bowstring, and movable between a position for retaining a partially drawn tensed said bowstring and a retracted position free of said bowstring; and biasing means for providing force to motivate said arm means from said bowstring retaining position to said retracted position outside the plane of movement of said bowstring.

2. The bowstring hold-back apparatus of claim 1 wherein said arm means is maintained in a bowstring retaining position by said partially drawn tensed bowstring resting thereon, and said arm means is motivated by said biasing means to said retracted position upon further rearward drawing of said bowstring from said arm means.

3. The bowstring hold-back apparatus of claim 1, wherein said bow is a compound bow and said support shaft is a cable guard.

4. The bowstring hold-back apparatus of claim 1, wherein said biasing means is a spring which is adjustable to vary said force motivating said arm.

5. A hold-back assembly for a bowstring of an archery bow having an overdraw structure and a bowstring at-rest position, said hold-back assembly comprising:

a support rod having one end fixedly attachable to said archery bow and the opposite end portion extending rearwardly therefrom past said bowstring at-rest position:

an annular retaining ring having a passageway therethrough, said support rod passing through said passageway for lockable mounting of said ring on said support rod;

a pivot collar assembly having a passageway therethrough for lockable mounting on said support rod, said collar assembly including an annular collar of enlarged outer diameter on a first end and an annular bearing of smaller outer diameter at an opposing end;

a pivot arm assembly comprising:

a hub having a bearing passageway therethrough, said annular bearing rotatably mounted in said bearing passageway for rotatable mounting of said hub on said annular bearing, an arm integral with said hub and extending radially therefrom to intersect said bowstring and retain said bowstring in a partially drawn position, and wherein said hub includes a circumferential space about said bearing passageway for containing a spring;

a spring having a first end attached to said pivot arm assembly within said circumferential space and a second end attached to said pivot collar, said spring urging said pivot arm assembly to rotate relative to said pivot collar when said spring is forcibly extended; and locking means for locking said retaining ring and said pivot collar assembly to said support rod, said retaining ring and pivot collar disposed on opposite ends of said hub to retain said pivot arm assembly therebetween wherein said arm pivots in a plane radial to said support rod.

6. The hold-back assembly of claim 5, wherein said support rod comprises a cable guard.

7. The hold-back assembly of claim 5, wherein said annular retaining ring is slidably adjustable on said support rod to control the distance from said at-rest position to said retained partially drawn position.

8. The hold-back assembly of claim 5, wherein said spring comprises a coil spring.

9. A hold-back assembly for a bowstring of an archery bow having an overdraw structure and a bowstring at-rest position, said hold-back assembly comprising:

support rod means having one end attachable to said archery bow and an opposite end portion extending rearwardly therefrom past said bowstring at-rest position;

hold-back body means with a support rod passageway for passage of said support rod means therethrough and an arm passageway through said hold-back body means at approximately a right angle with said support rod passageway;

bowstring retaining arm means passing through said arm passageway, said arm means having an enlarged end for engaging said bowstring and an opposite end portion with spring retaining means mounted thereon; and a spring mounted on said retaining arm means in compression between said body means and said spring retaining means to motivate said arm means in a straight line from an extended string engaging portion to a retracted position outside the plane of movement of said bowstring.

10. The hold-back assembly of claim 9, wherein said spring retaining means is slidably adjustable on said arm means for controlling said compression.

11. The hold-back assembly of claim 9, wherein a portion of said spring is recessed into said body means.

12. The hold-back assembly of claim 9, wherein said support rod comprises a cable guard.

13. A hold-back assembly for a bowstring of an archery bow having an overdraw structure and a bowstring at-rest position, said hold-back assembly comprising:

support rod means having one end attachable to said archery bow and an opposite end portion extending rearwardly therefrom past said bowstring at-rest position;

hold-back body means with a support rod passageway for passage of said support rod means therethrough and first and second stop means for confining the pivoting movement of a bowstring retaining arm means;

bowstring retaining arm means pivotally mounted on said hold-back body means to pivot between said first stop means at a bowstring retaining position to said second stop means comprising a rearward directed retracted position outside the plane of movement of said bowstring;

a pivot shaft mounted on said body means and having said arm means mounted thereon; and a spring having a first end attached to said body means and a second end acting upon said arm means to motivate said arm means to said retracted position.

14. The hold-back assembly of claim 13, wherein said support rod comprises a cable guard.

15. The hold-back assembly of claim 14, wherein said body is slidably adjustable on said support rod to control the distance from said at-rest position to said retained partially drawn position.

16. A combination cable guard and bowstring hold-back for a compound overdraw archery bow with cables and a bowstring having an at-rest position and a plane of movement comprising:

a cable guard rod fixedly attached to the handle of said archery bow, and extending rearwardly past said bowstring at-rest position, said cable guard adapted to hold said cables out of said bowstring plane of movement;

arm means mounted on said cable guard rod and movable between a first partially drawn bowstring retaining position intersecting said bowstring plane of movement and a second retracted position away from said bowstring plane of movement; and biasing means for providing motivating force to move said arm from said first position to said second position upon further drawing of said bowstring.

17. The combination cable guard and bowstring hold-back of claim 16, said biasing means is a spring.

18. A hold-back assembly for an archery bow having a bowstring movable between a drawn position and an at-rest position, comprising:

support rod means rigidly attached to said bow and extending rearwardly outside the plane of movement of said bowstring to proximate a partially drawn position of said bowstring;

hub means attached to said support rod;

arm means attached to said hub means for pivotal movement between a bowstring holding position and a bowstring release position; and arm biasing means to bias said arm means to said bowstring release position upon further drawing of said bowstring from said partially drawn position to a position rearwardly of said partially drawn position.

19. A bowstring hold-back apparatus for an archery bow with an overdraw structure and a bowstring having an at-rest position, comprising:

a support shaft mounted on said bow and extending rearward past said at-rest position of said bowstring;

arm means mounted on said support shaft rearward of said at-rest position of said bowstring, and movable between a position for retaining a partially drawn tensed said bowstring and a retracted position free of said bowstring, said arm means including a passageway therethrough, said support shaft slidingly passing through said passageway, and means for locking said arm means at an adjustable position on said support shaft rearward of said at-rest position; and biasing means for providing force to motivate said arm means from said bowstring retaining position to said retracted position outside the plane of movement of said bowstring.

20. A bowstring hold-back apparatus for attachment to a support means of an archery bow with a bowstring movable between a drawn position and an at-rest position, comprising:

attachment means rigidly secured to said support means of said bow;

an arm pivotally connected to said attachment means, said arm being pivotable between a first position wherein an end thereof is in the plane of travel of the bowstring when released from the drawn position and a second position out of said plane of travel;

means engaging said attachment means and said arm to bias said arm to said second position out of said plane of travel; and means for adjustably changing the distance between said end of said arm in said first position and said support means.

21. A bowstring hold-back apparatus as in claim 20, wherein said means to bias said arm to said second position comprises a spring carried by said arm.

22. A bowstring hold-back apparatus as in claim 21, wherein:

said attachment means is a support shaft having one end fixed to said support means and a portion extending beyond said at-rest position of said bowstring in a plane offset from said plane of travel;

said arm is mounted on said support shaft to rotate about the longitudinal axis of said shaft; and said means to bias said arm to said second position is a coil spring having one end fixed to said arm and another end fixed to said shaft.

23. A bowstring hold-back apparatus as in claim 21, wherein:

said attachment means is a support shaft having one end fixed to said support means and a portion extending beyond said at-rest position of the bowstring in a plane offset from said plane of travel;

said arm is mounted to reciprocate transversely to the longitudinal axis of said shaft; and said means to bias the arm to said second position comprises a coil spring surrounding said arm and acting between said arm and structural reaction means fixed to said shaft.

24. An archery bow, comprising:

a support means;

a pair of limbs extending at opposite directions from said support means;

a bowstring connected across said limbs and movable between a drawn position and an at-rest position;

a hold-back apparatus including attachment means rigidly secured to said support means;

an arm pivotally connected to said attachment means, said arm being pivotable between a first position wherein an end thereof is in the plane of travel of the bowstring when released from said drawn position and a second position out of said plane of travel;

means engaging said attachment means and said arm to bias said arm to said second position; and means for adjustably changing the distance between said end of said arm in said first position and said support means.

* * * * *